US008976072B2

(12) United States Patent
Lenormand et al.

(10) Patent No.: US 8,976,072 B2
(45) Date of Patent: Mar. 10, 2015

(54) FLAT SCANNING ANTENNA FOR A TERESTRIAL MOBILE APPLICATION, VEHICLE HAVING SUCH AN ANTENNA, AND SATELLITE TELECOMMUNICATION SYSTEM COMPRISING SUCH A VEHICLE

(75) Inventors: Regis Lenormand, Blagnac (FR); Jean-Michel Merour, Castelnau d'Estretefonds (FR); Jean-Michel Mateus, Toulouse (FR); Ronan Sauleau, Acigne (FR); Mauro Ettorre, Leporano (IT); Gerard Raguenet, Eaunes (FR)

(73) Assignee: Thales, Neuilly sur Seine (FR)

( * ) Notice: Subject to any disclaimer, the term of this patent is extended or adjusted under 35 U.S.C. 154(b) by 314 days.

(21) Appl. No.: 13/521,965

(22) PCT Filed: Jan. 17, 2011

(86) PCT No.: PCT/EP2011/050513

§ 371 (c)(1),
(2), (4) Date: Jul. 12, 2012

(87) PCT Pub. No.: WO2011/095384

PCT Pub. Date: Aug. 11, 2011

(65) Prior Publication Data

US 2012/0287006 A1 Nov. 15, 2012

(30) Foreign Application Priority Data

Feb. 5, 2010 (FR) ..... 10 00473

(51) Int. Cl.

| | |
|---|---|
| ***H01Q 13/10*** | (2006.01) |
| ***H01Q 3/00*** | (2006.01) |
| ***H01Q 1/32*** | (2006.01) |
| ***H01Q 3/04*** | (2006.01) |
| ***H01Q 3/26*** | (2006.01) |
| ***H01Q 21/00*** | (2006.01) |

(52) U.S. Cl.

CPC ..... *H01Q 1/3275* (2013.01); *H01Q 3/04* (2013.01); *H01Q 3/26* (2013.01); *H01Q 21/005* (2013.01)

USPC ..... 343/771; 343/762

(58) Field of Classification Search

CPC ..... H01Q 21/005

USPC ..... 343/757, 762, 771

See application file for complete search history.

(56) References Cited

U.S. PATENT DOCUMENTS

| | | | | |
|---|---|---|---|---|
| 6,873,301 | B1 * | 3/2005 | Lopez | 343/770 |
| 2011/0175780 | A1 * | 7/2011 | Gatti et al. | 343/766 |

FOREIGN PATENT DOCUMENTS

| | | | |
|---|---|---|---|
| JP | 5-6921 | A1 | 1/1993 |
| WO | 03/043124 | A1 | 5/2003 |
| WO | 2009/144763 | A1 | 12/2009 |

OTHER PUBLICATIONS

Katsumasa Miyata, "A 12 GHz-Band Planar Waveguide Array Antenna for Compact Range Application", Digest of the Antennas and Propagation Society International Symposium, Jun. 19-24, 1994, pp. 270-273, vol. 1, IEEE, New York, XP010142164.

*Primary Examiner* — Robert Karacsony

(74) *Attorney, Agent, or Firm* — Baker and Hostetler LLP

(57) ABSTRACT

A flat scanning antenna comprises at least one slotted waveguide array comprising two dielectric substrates, one superposed above the other. The two substrates comprise the same number of waveguides, which are in mutual correspondence and communicate between them, pairwise, via corresponding coupling slots. Each waveguide of the upper substrate further includes a plurality of radiating slots, all the radiating slots being mutually parallel and oriented in the same direction and each waveguide of the lower substrate includes an individual internal supply circuit comprising an individual phase-shift/amplification electronic circuit.

9 Claims, 4 Drawing Sheets

FLAT SCANNING ANTENNA FOR A TERESTRIAL MOBILE APPLICATION, VEHICLE HAVING SUCH AN ANTENNA, AND SATELLITE TELECOMMUNICATION SYSTEM COMPRISING SUCH A VEHICLE

CROSS-REFERENCE TO RELATED APPLICATIONS

This application is a National Stage of International patent application PCT/EP2011/050513, filed on Jan. 17, 2011, which claims priority to foreign French patent application No. FR 1000473, filed on Feb. 5, 2010, the disclosures of which are incorporated by reference in their entirety.

FIELD OF THE INVENTION

The present invention relates to a flat scanning antenna, to a vehicle having such an antenna and to a satellite telecommunication system comprising such a vehicle. It applies notably to the satellite telecommunications field and more particularly to telecommunication equipment onboard mobile vehicles, such as terrestrial, maritime or aeronautical transport means, for providing a two-way connection between a mobile terminal and an earth station via a repeater onboard a satellite.

BACKGROUND

In transport means such as trains and buses, there is an increasing requirement both for connections to a broadband Internet service and for small low-cost high-performance antennas.

Currently, it is known to produce a satellite link between a mobile terminal and an earth station, for example to provide an Internet connection for the passengers on a train or bus, using an antenna which is not very directional, operating in the L band. The problem is that, in the L band, there are very few available frequencies and the communication transmission rate is therefore very low. To increase the rate, it is necessary to establish links with satellites operating in the Ku (10.5 GHz to 14.5 GHz) band or the Ka (20 to 30 GHz) band and to produce directional antennas. However, with a directional antenna, it is necessary for it to be continuously pointed at the satellite irrespective of the position of the vehicle.

To cover a territory such as Europe, the transmission/reception specifications for a mobile terminal capable of providing the required transmission quality lead, in the Ku band, to antenna gains typically of around 34 to 35 dB over the area covered and the antenna must be capable of being pointed, both in transmission and in reception, within an angular range between 0° and 360° in azimuth and between 20° and 60° on average in elevation.

Such performances may be achieved using an antenna array comprising elementary radiating elements, the phase of which is controlled so as achieve precise pointing in a chosen direction. These array antennas have the advantage of being flat and therefore of small size in their height direction. However, since the angular range to be covered is very large, in order to obtain good performance and to avoid the appearance of array lobes in the radiation pattern of the antenna, it is necessary to use a beam-forming array comprising a very large number of phase controls, something which is prohibited. For example, for an antenna in the Ku band having an area of the order of 1 $m^2$, the number of radiating elements of the antenna must be greater than 15000, this being unacceptable in terms of cost and complexity of the antenna for an application in transport means.

It is also possible to point an antenna within a wide angular range using mechanical pointing. In this type of antenna, the antenna is pointed towards the satellite by a combination of two mechanical movements. A first mechanical movement is achieved by means of a rotating platform lying in a plane XY and orienting the antenna both in elevation and in azimuth. A second movement in elevation is performed by an ancillary device, for example a flat mirror fastened to the platform. The antenna conventionally includes a parabolic reflector and a radiating source illuminating the reflector. To reduce the overall size of the reflector and to reduce the height of the antenna, its periphery is elliptical instead of circular. Typically, such an antenna currently deployed on high-speed trains has a height of the order of 45 cm. Although this height is compatible with current trains, it is too large for future double-decker high-speed trains for which the available height for fitting an antenna, between the roof of the train and the catenaries, is much too small.

Moreover, for an application in the aeronautical field, the height of the antenna has an influence on the drag caused by the aircraft and on the fuel consumption. For example, current reflector antennas fitted onto aircraft have a height of the order of 30 cm and increase the fuel consumption, equivalent to eight additional passengers.

There are architectures for reducing the height of the mechanically pointed antenna. According to a first architecture, the antenna is made up of two parallel plates, between which longitudinal current components flow, and an array having a line of continuous transverse slots that couple and radiate the energy into space. The two plates and the array of slots are mounted on two coplanar mounts mechanically rotating independently of each other, the two rotational movements being superposed and carried out in the same plane of the mounts. The orientation of the lower mount is used to adjust the pointing direction in azimuth while the orientation of the upper mount is used to vary the inclination of the slots and thus modify the pointing direction in elevation of the beam generated by the antenna. However, since this antenna initially operates in linear polarization mode, it is necessary to add an additional steerable polarization grid mounted on the upper face of the antenna in order to control the plane of polarization of the antenna, thereby increasing the implementation complexity and the height of the antenna, which is therefore not flat.

According to a second low-height flat antenna architecture, the antenna comprises several alternating substrate planes and metal planes superposed one above another. The antenna comprises a first, lower metal plane, then a first substrate plane comprising several sources, the first substrate plane having a lateral end forming a parabolic surface on which the waves transmitted by the sources are reflected. Above the first substrate plane is a second metal plane having slots for coupling the reflected wave plane, each coupling slot emerging in respective slotted waveguides placed side by side so as to be mutually parallel in a same second substrate plane. The guided waves are then transmitted in the form of a radiated beam through a plurality of radiating apertures made in a third, upper metal plate. Scanning and depointing of the beam in elevation, in a plane perpendicular to the plane of the antenna, is achieved by switching the various sources, but no pointing modification in azimuth is possible. Moreover, this very compact antenna has the drawback of requiring high-power switching means, something which has never been simple to achieve. Furthermore, the sources are switched discretely, thereby preventing the beam from being continuously pointed. Finally, this very compact antenna is powered by a single power source, thereby requiring the use of bulky power amplifiers, which considerably increase the volume of the antenna, which becomes too large for an application in transport means.

To solve the problem of discrete pointing of this flat antenna, it has been proposed to use only a single source and to place the flat antenna on a rotating platform for adjusting the pointing in azimuth, the platform having an articulated mirror on the platform, the angle of inclination of which to the plane of the platform can be varied by rotation. The plane wave transmitted by the source illuminates the mirror, which reflects this wave in a chosen pointing direction, the angle of inclination of the mirror enabling the angle of elevation of the transmitted beam to be adjusted. This antenna is very elliptical, the size of the mirror in its articulated region on the platform being much greater than the size of the mirror in its inclined region above the platform, thereby making it possible to reduce the height of the antenna to 20 or 30 cm, but this height still remains too large for an application in transport means.

SUMMARY OF THE INVENTION

The object of the invention is to produce a flat scanning antenna that does not have the drawbacks of the existing antennas and can be fitted onto a mobile transport means. In particular, the object of the invention is to produce a directional flat antenna, which operates in the Ku band, is very compact in its height direction, is simple to implement, of low cost and capable of remaining pointed continuously at a satellite irrespective of the position of the transport means and enabling the plane of polarization to be controlled without the addition of a steerable grid.

To do this, the invention relates to a flat scanning antenna comprising at least one slotted waveguide array, the slotted waveguide array comprising two dielectric substrates, namely the lower and upper respectively, one superposed above the other. The two, lower and upper substrates Sub1, Sub2 comprise the same number of waveguides corresponding thereto and each waveguide of the upper substrate communicates with a corresponding single waveguide of the lower substrate via a coupling slot. Each waveguide of the upper substrate Sub2 further includes a plurality of radiating slots, all the radiating slots being mutually parallel and oriented in the same direction parallel to a longitudinal axis of the waveguides and each waveguide of the lower substrate Sub1 includes an individual internal supply circuit comprising an individual phase-shift/amplification electronic circuit.

According to one embodiment, in each dielectric substrate, the waveguides are placed so as to be parallel, one beside another, and comprise upper and lower metal walls parallel to a plane of the antenna. In this case, advantageously, upper and lower walls of all the waveguides can be formed by three flat metal plates, a lower metal plate, an intermediate metal plate and an upper metal plate respectively, which are parallel to the plane of the antenna, the coupling slots passing through the intermediate metal plate and the radiating slots passing through the upper metal plate.

According to another embodiment, in each dielectric substrate, the waveguides are placed so as to be mutually parallel, one beside another, and comprise upper and lower metal walls inclined to a plane of the antenna.

Advantageously, the slotted waveguide array is mounted on a platform that can rotate azimuthally.

Preferably, the antenna comprises two identical slotted waveguide arrays dedicated to transmission and to reception respectively.

Preferably, the antenna comprises, both at transmission and at reception:

- a main slotted waveguide array and an auxiliary slotted waveguide array, the two arrays each comprising a first internal phase-shift circuit, set to the same phase value, the auxiliary array having radiating slots inclined at a non-zero angle to the slots of the main array; and
- a second phase-shift circuit placed at the input of the main array, the second phase-shift circuit being intended to compensate for a rotation of the plane of polarization of a wave transmitted by the main array and comprising a phase shifter having a variable phase between 0° and 180°, and a variable-gain amplifier.

Preferably, the angle of inclination of the radiating slots of the main array is between 20° and 70°.

The invention also relates to a vehicle having at least one such antenna and to a satellite telecommunication system comprising at least one such vehicle.

BRIEF DESCRIPTION OF THE DRAWINGS

Other features and advantages of the invention will become clearly apparent in the rest of the description, given by way of purely illustrative and non-limiting example, with reference to the appended schematic drawings which show.

DETAILED DESCRIPTION

Figure 1A:
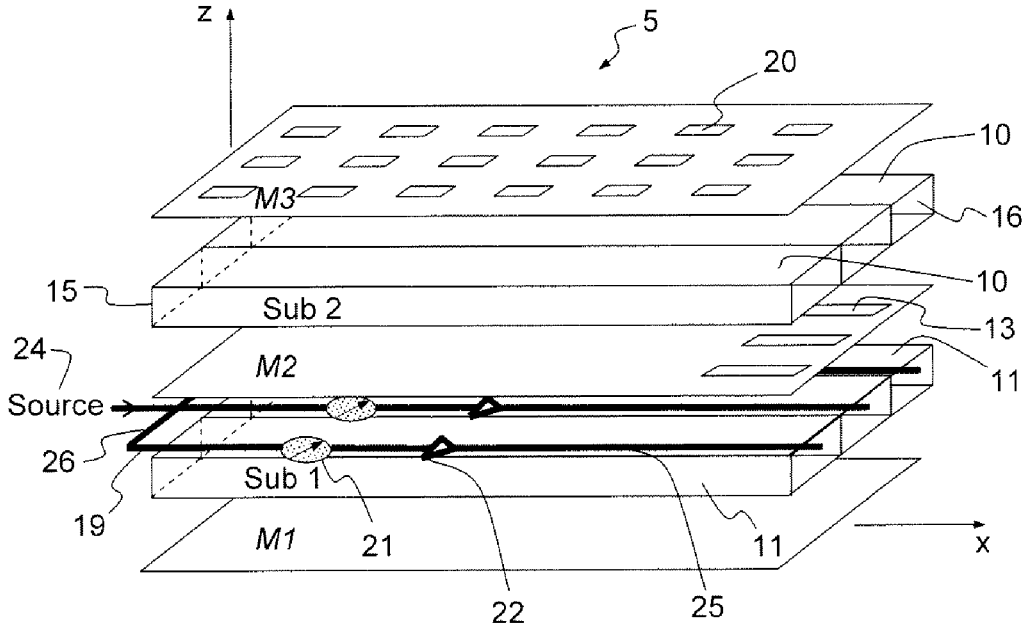
FIGS. 1*a* and 1*b*: two diagrams, in perspective and in section parallel to the XZ plane, respectively, of a first example of a flat antenna according to the invention.
Figure 1B:
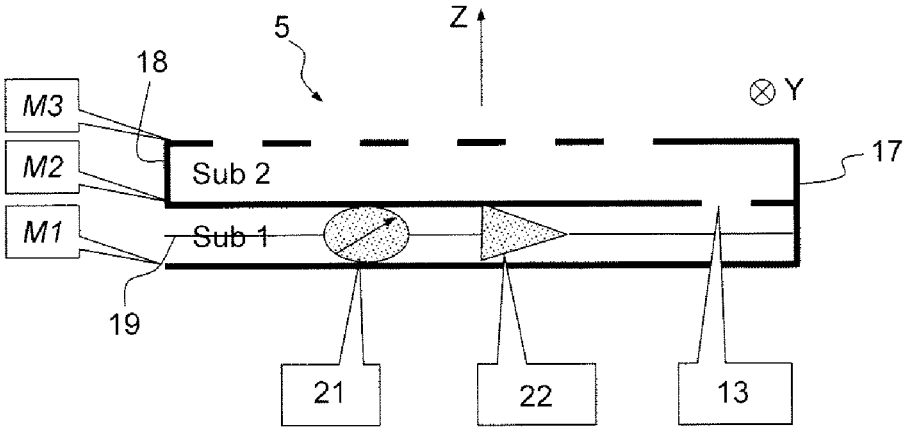
Figure 1C:
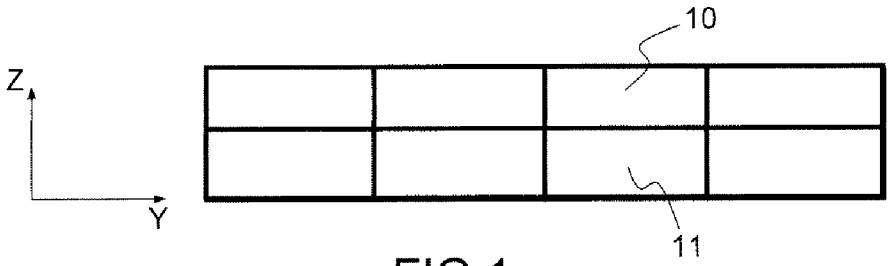
FIG. 1*c*: a schematic view in cross section of an example of an arrangement of the waveguides in which the walls of the waveguides are parallel to the XY plane of the antenna, according to a first embodiment of the invention.
Figure 1D:
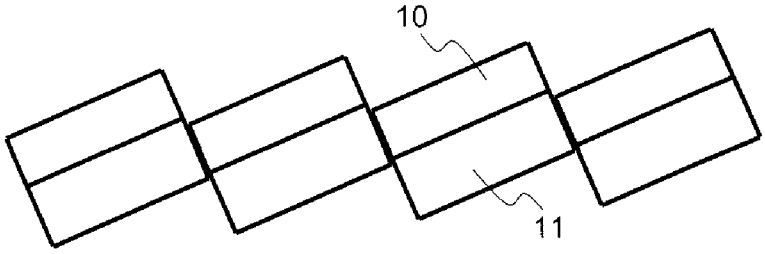
FIG. 1*d*: a schematic view in cross section, parallel to the YZ plane, of an example of an arrangement of the waveguides in which the walls of the waveguides are inclined to the XY plane of the antenna, according to a second embodiment of the invention.

The flat antenna shown in FIGS. 1*a*, 1*b* and 1*c* comprises a slotted waveguide array 5 comprising two, respectively lower and upper, dielectric substrates Sub1, Sub2 which are superposed one above the other. The upper dielectric substrate Sub2 supports slotted waveguides 10, and the lower substrate Sub1 supports waveguides 11 intended for individually supplying each slotted waveguide 10 with a microwave signal. Three slotted waveguides are shown in FIG. 1*a* and four slotted waveguides are shown in FIGS. 1*c* and 1*d*, but these numbers are not limiting and may take any value equal to or greater than one. Preferably, the waveguides have a rectangular cross section. In the embodiment corresponding to FIGS. 1*a*, 1*b*, 1*c*, the planes of the various layers of the antenna are parallel to the XY plane and, in each substrate layer, the waveguides are placed beside one another, so as to be parallel to the XY plane. The upper and lower walls of all the waveguides are then formed by three metal plates M1, M2, M3, respectively the lower, intermediate and upper metal plates, which are parallel to the XY plane and delimit the two dielectric substrates provided with the waveguides, the two dielectric substrates Sub1, Sub2 being inserted between two consecutive metal plates. The height direction of the antenna is along a Z axis orthogonal to the XY plane. There are the same number of slotted waveguides 10 of the upper substrate as the number of waveguides 11 of the lower substrate, these waveguides being in pairwise correspondence and communicating pairwise between them via coupling slots made in the intermediate metal plate M2. Thus, in FIG. 1*a* each waveguide 11 of the lower substrate Sub1 has two, lower and upper, metal walls, formed by the lower metal plate M1 and the intermediate metal plate M2 respectively, and lateral metal walls connecting the two, lower M1 and intermediate M2, metal plates. Each waveguide 11 of the lower substrate Sub1 further includes a coupling slot 13 passing through the intermediate metal plate M2 and emerging in a single waveguide 10 corresponding to the upper substrate Sub2. The coupling slots 13 that supply each waveguide 10 of the upper substrate Sub2 may for example emerge in the middle of each waveguide 10 or at one end 16 of these waveguides, as in FIGS. 1*a* and 1*b*, or at another place in these waveguides 10. Each waveguide 10 of the upper substrate Sub2 has two, lower and upper, metal walls, formed by intermediate M2 and upper M3 metal plates, respectively, and lateral metal walls connecting the two, intermediate M2 and upper M3, metal plates. The waveguides 10, 11 extend along a longitudinal axis parallel to the same direction, which may correspond for example, to the X axis, and have two opposed ends 15, 16 along this axis. As shown in FIG. 1*b*, the waveguides of the upper substrate Sub2 are closed at their two ends 15, 16 by two transverse metal walls 17, 18 connecting the three metal plates M1, M2 and M3, whereas the waveguides of the lower substrate are closed only at one end 16 by the transverse wall 17, their open end 15 corresponding to a signal input 19. Each waveguide 10 of the upper substrate Sub2 further includes a plurality of radiating slots 20 passing through the upper metal plate M3, all the radiating slots 20 being mutually parallel and oriented in the same direction parallel to the longitudinal axis of the waveguides, for example the X direction, the Y direction orthogonal to the X direction in the XY plane of the slots corresponding to a linear polarization wave plane. The slots may be aligned along the longitudinal X axis of the waveguides or offset by a distance ds with respect to this axis, as shown in the example in FIG. 3*a*. Each waveguide 11 of the lower substrate Sub1 includes an individual internal supply circuit 25 capable of receiving an incoming microwave signal 19 applied at its open end, this individual internal supply circuit 25 comprising an individual internal phase-shift/amplification electronic circuit comprising an internal phase shifter 21, for controlling the phase of the signal to be transmitted, and an internal amplification device 22 for amplifying the incoming signal, enabling the radiation transmitted by the antenna to be controlled. The incoming signal 19 may be transmitted for example by an external source 24, for example a single signal, then divided by a divider 26 connected at the input of each of the waveguides 11 of the lower substrate Sub1. After the incoming signal 19 has been phase-shifted by the phase shifter 21 and amplified by the device 22 in one of the waveguides 11 of the lower substrate Sub1, it is transmitted in a corresponding waveguide 10 of the upper substrate Sub2 via the coupling slots 13 in the intermediate metal plate M2 and then radiated by the radiating slots 20. Scanning and depointing of the beam in elevation, in a YZ plane perpendicular to the XY plane of the antenna, is achieved by controlling the phase/amplitude law applied electronically by the individual internal supply circuits for each waveguide 11 of the lower substrate corresponding to each of the slotted waveguides 10. The waveguides shown in FIG. 1*a* are arranged so as to be all parallel to the metal plates M1, M2, M3. In one particular embodiment shown schematically in cross section in a plane of section parallel to the YZ plane in FIG. 1*d*, for very large depointing values, for example greater than 50°, it is also possible to incline each waveguide at a predetermined angle, for example between 10° and 20°, to the XY plane of the antenna. In this case, the lower and upper walls of the various waveguides are not formed by flat metal plates M1, M2, M3 but by metal walls that are inclined to the XY plane, the metal plates M1, M2, M3 being replaced with metal walls in a sawtooth configuration.

Since each waveguide 11 of the lower substrate Sub1 is supplied individually by an internal circuit 25 and has an individual internal phase-shift 21/amplification 22 electronic circuit, the phase is controlled continuously, thereby making it possible for the direction of radiation of the antenna in elevation to be continuously controlled. Moreover, the amplification is distributed within each waveguide 11, thereby enabling low-power amplifiers to be used and dispensing with a complex and bulky external amplification circuit. Furthermore, no high-energy source switching means is necessary for continuously scanning the beam.

Figure 2:
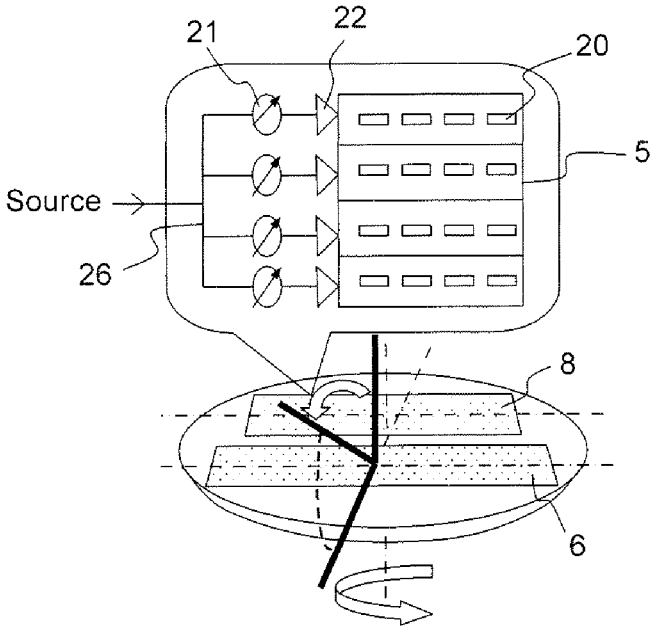
FIG. 2: a diagram of a second example of a flat antenna having separate transmission and reception functions, according to the invention.

By placing the flat antenna 6 thus obtained on an azimuthally rotating platform 7, the pointing of the beam in azimuth is achieved by rotating the platform and the pointing of the beam in elevation is given by the phase law applied to the incoming signals 19. This phase law is obtained by controlling the internal phase shifters 21 and the internal amplifiers 22 integrated into each of the waveguides 11 of the lower substrate Sub1. Advantageously, since the slotted waveguides 10 operate within a small bandwidth, it is possible to separate the transmission functions from the receiving function and to use, as shown in FIG. 2, a system of flat antennas 6, 8 comprising a first slotted waveguide array dedicated to transmission and a second slotted waveguide array, not shown, dedicated to reception, the two slotted waveguide arrays being identical and mounted on the same azimuthally rotating platform 7. The pointing in elevation of each of the transmit and receive antennas of the system of flat antennas mounted on the rotating platform is achieved by amplification and electronic control of the phases of each of the signals running through the slotted waveguides forming the radiating arrays of the two antennas.

Figure 3A:
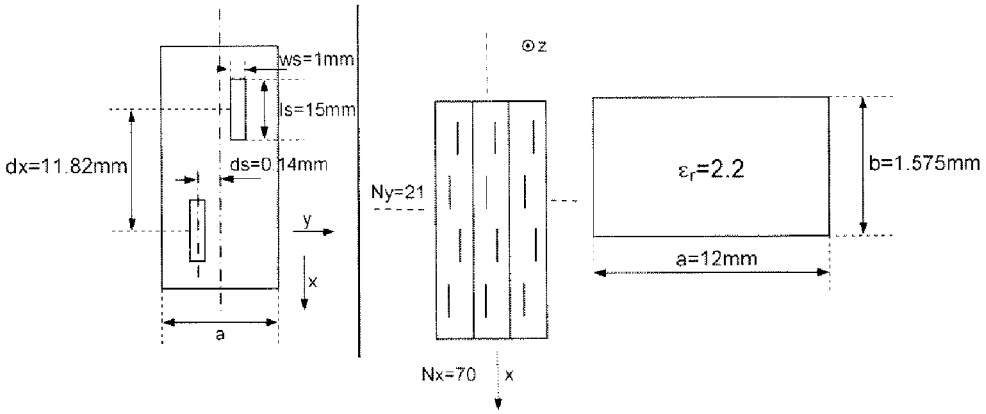
FIGS. 3*a*, 3*b*: an example of one design of a slotted waveguide array and a radiation pattern obtained with a flat antenna having this array, according to the invention.
Figure 3B:
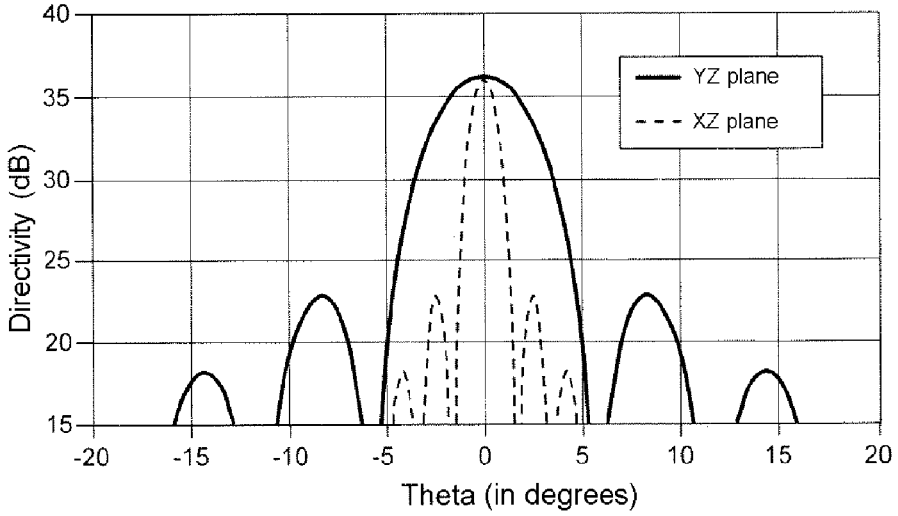

FIG. 3*b* shows a non-limiting example of a radiation pattern obtained with a flat antenna having a structure in accordance with FIGS. 1*a* and 1*b* and comprising an array of Ny=21 slotted waveguides and Nx=70 slots per waveguide, the slots being uniformly distributed along each waveguide. As shown in FIG. 3*a*, in this example the waveguides have a dielectric constant $\in_r$ of 2.2 and a rectangular cross section with a=12 mm in length and b=1.575 mm in height. The slots are rectangular and their dimensions are ls=15 mm in length along the X direction and ws=1 mm in width along the Y direction. The spacing between two consecutive slots is dx=11.82 mm in the length direction X. Two consecutive slots may be offset one with respect to the other along the Y direction. In FIG. 3, the offset is ds=0.14 mm relative to the mid-line separating two slots. The antenna thus obtained has the following dimensions: 840 mm in length by 242 mm in width. The height of the antenna without the rotating platform on which it is mounted is a few millimeters. The total height of the antenna with the rotating platform is almost equal to the height of the rotating platform, i.e. of the order of 2 to 3 cm. This antenna radiates a linearly polarized wave, the radiated wave plane being parallel to the slots. The radiation pattern obtained with this antenna has a main lobe with a maximum amplitude of 36.2 dB corresponding to the maximum directivity of the antenna, and a bandwidth at 3 dB with an angle θ equal to 1.5° in the XZ plane and 5° in the YZ plane.

This design example therefore shows that the flat antenna thus produced meets the imposed height conditions for being fitted onto a transport means and notably on a future high-speed train. However, when an antenna transmits a linearly polarized wave plane in a given direction, the satellite receives this wave in a direction that depends on the relative position of the satellite with respect to the local vertical of the vehicle with which the antenna is equipped and on the relative position of the vehicle with respect to the local vertical to the ground. The satellite must therefore see a wave having its polarization rotated through an angle ψ with respect to the plane of polarization of the wave transmitted by the antenna. If the vehicle moves within a geographical zone having slopes of less than 10%, the value of ψ remains at values below 15°. If this rotation is not compensated for, it has the effect of generating two crossed energy components at the satellite level. The satellite therefore receives a main energy component parallel to the plane of polarization of the transmitted wave and an additional energy component in a direction perpendicular to the main plane of polarization. Since this additional energy component may create interference for users employing this other plane of polarization, it is necessary to compensate for the angle of rotation ψ in order for the satellite to receive only a wave of perfectly aligned polarization. Since this angle of rotation ψ is always varying when the vehicle fitted with the antenna is moving, the compensation must be carried out continuously. To limit interference, this compensation must be carried out both in transmit mode and in receive mode.

Figure 4:
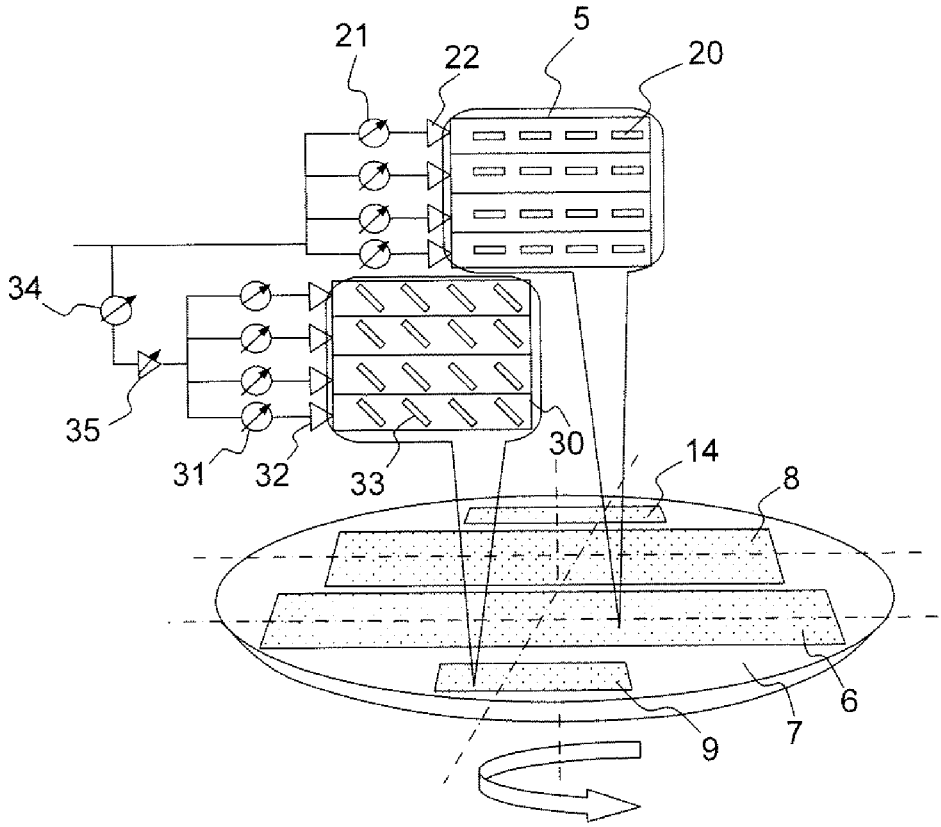
FIG. 4: a diagram of a third example of a flat antenna having separate transmission and reception functions and a transmission-optimized wave plane, according to the invention.
Figure 4:
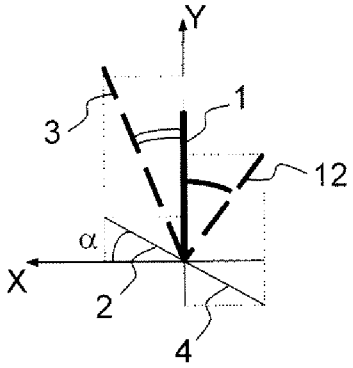

To compensate for the rotation of the plane of polarization in transmit mode, according to an additional feature of the invention, an auxiliary flat transmit antenna 9 and an auxiliary flat receive antenna 14 having the same structure as the main transmit antenna 6 and receive antenna 8 are mounted on the rotating platform 7 as shown in FIG. 4.

Each auxiliary flat antenna 9, 14 comprises an auxiliary slotted waveguide array 30 supplied in the same way as that of the main transmit array, that is to say by an internal phase-shift 31/amplification 32 circuit provided in the waveguides of the lower substrate of the auxiliary array, the phase shift being adjusted to the same value as that of the main array 5. The orientation of the radiating slots 33 of the auxiliary array 30 makes a non-zero angle α, preferably of between 20° and 70°, to the radiating slots 20 of the main transmission array 5 so as to transmit a secondary wave having a plane of polarization 2 inclined to the plane of polarization 1 of the main wave transmitted by the main array 5.

The auxiliary array 30 is used to obtain, in the direction of the beam transmitted by the main array, a secondary beam possessing amplitude, phase and polarization characteristics independent of the main array. The polarization components in the two wave planes 1, 2 transmitted by the two arrays, namely the main array 5 and the auxiliary array 30, are combined vectorially into an overall resultant wave having a plane of polarization 3.

Since the plane wave transmitted by the auxiliary antenna 9, 14 is polarized in a wave plane perpendicular to the direction of orientation of the slots 33 of the auxiliary antenna 9, 14, it therefore has two polarization components parallel to the X and Y axes.

By adjusting the polarization, phase and amplitude parameters of the wave transmitted by the auxiliary array 30, it is then possible to obtain, at the satellite, an overall resultant wave having the plane of polarization 3 aligned with the plane of polarization 1 of the transmitted main wave and of thus compensating for the angel of rotation ψ of the polarization of the main wave received by the satellite. For example, by applying a phase equal to 180° to the wave transmitted by the auxiliary array 30, which corresponds to the plane of polarization 4, the overall resultant wave has a plane of polarization along the direction 12.

To do this, a second phase-shift circuit, intended to compensate for rotation of the plane of polarization of a wave transmitted by the main array, is placed at the input of the auxiliary array 30. The second phase-shift circuit comprises a phase shifter 34 having a variable phase between 0° and 180° and a variable-gain amplifier 35.

To give a non-limiting example, as shown in FIG. 4, the radiating slots 33 of the auxiliary array 30 may be chosen to be oriented at 45° to the radiating slots 20 of the main array 5. The input phase shifter 34 having a variable phase between 0° and 180° and the variable-gain input amplifier 35 are used to adjust the amplitude and the phase of the signal delivered by the transmission source and sent, via a power divider 36, to the auxiliary array 30 and thus control the orientation of the plane of polarization 3 of the transmitted resultant wave arising from the combination of the two waves radiated by the two radiating arrays, namely the main array 5 and the auxiliary array 30. Since the secondary wave is only intended to compensate for the angle of rotation ψ, its sole use is to create a component of the wave plane perpendicular to the main wave plane, and the amplitude of the wave that it transmits can therefore be much lower than the amplitude of the main wave. The auxiliary antenna 9, 14 may therefore be of much smaller size than that of the main antenna 6, 8 and therefore the number of waveguides and number of slots of the secondary antenna may be much fewer than those of the main antenna.

Although the invention has been described in connection with particular embodiments, it is obvious that it is no way limited thereto and that it comprises all technical equivalents of the means described and all combinations thereof provided that they fall within the scope of the invention.

The invention claimed is:

1. A flat scanning antenna comprising at least one slotted waveguide array, wherein:

the slotted waveguide array comprises two dielectric substrates, namely lower substrate and upper substrate, one superposed above the other;

the lower and upper substrates comprise the same number of waveguides corresponding thereto;

each waveguide of the upper substrate communicates with a corresponding single waveguide of the lower substrate via a coupling slot;

each waveguide of the upper substrate further includes a plurality of radiating slots, all the radiating slots being mutually parallel and oriented in the same direction parallel to a longitudinal axis (X) of the waveguides;

each waveguide of the lower substrate includes an individual internal supply circuit comprising an individual internal phase-shift/amplification electronic circuit; and in each dielectric substrate, the waveguides are placed so as to be mutually parallel, one beside another, and comprise upper and lower metal walls inclined to a plane of the antenna.

2. A flat antenna according to claim 1, wherein, in each dielectric substrate, the waveguides are placed so as to be parallel, one beside another, and comprise upper and lower metal walls parallel to a plane (XY) of the antenna.

3. A flat antenna according to claim 2, wherein the upper and lower walls of all the waveguides are formed by three flat metal plates, a lower metal plate, an intermediate metal plate and an upper metal plate respectively, which are parallel to the plane of the antenna, the coupling slots passing through the intermediate metal plate and the radiating slots passing through the upper metal plate.

4. A flat antenna according to claim 1 wherein the slotted waveguide array is mounted on a platform that can rotate azimuthally.

5. A flat antenna according to claim 1, further comprising two identical slotted waveguide arrays dedicated to transmission and to reception respectively.

6. A flat antenna according to claim 3, further comprising, both at transmission and at reception:

a main slotted waveguide array and an auxiliary slotted waveguide array, the two arrays each comprising a first internal phase-shift circuit set to the same phase value, the auxiliary array having radiating slots inclined at a non-zero angle to the slots of the main array; and a second phase-shift circuit placed at the input of the auxiliary array, the second phase-shift circuit being intended to compensate for a rotation of the plane of polarization of a wave transmitted by the main array and comprising a phase shifter having a variable phase between 0° and 180°, and a variable-gain amplifier.

7. A flat antenna according to claim 6, wherein the angle of inclination of the radiating slots of the auxiliary array is between 20° and 70°.

8. A vehicle having at least one antenna according to claim 1.

9. A satellite telecommunication system comprising at least one antenna mounted on a vehicle according to claim 8.

* * * * *